US006168487B1

(12) United States Patent
Nissen

(10) Patent No.: US 6,168,487 B1
(45) Date of Patent: Jan. 2, 2001

(54) INFLATABLE STRUCTURE, IN PARTICULAR A LIFE FLOAT

(75) Inventor: Richardt Brodersen Nissen, Esbjerg (DK)

(73) Assignee: Thanner & Co. A/S, Esbjerg (DK)

( * ) Notice: Under 35 U.S.C. 154(b), the term of this patent shall be extended for 0 days.

(21) Appl. No.: 09/147,092

(22) PCT Filed: Apr. 3, 1997

(86) PCT No.: PCT/DK97/00147

§ 371 Date: Oct. 2, 1998

§ 102(e) Date: Oct. 2, 1998

(87) PCT Pub. No.: WO97/41027

PCT Pub. Date: Nov. 6, 1997

(30) Foreign Application Priority Data

Apr. 3, 1996 (DK) ..... 0396/96

(51) Int. Cl.[7] ..... B63C 9/18
(52) U.S. Cl. ..... 441/92; 114/345; 441/41
(58) Field of Search ..... 114/345; 441/40, 441/41, 92–97

(56) References Cited

U.S. PATENT DOCUMENTS 2,993,217 7/1961 Switlik .
3,142,850 8/1964 De Boer .
3,359,579 * 12/1967 Reffell et al. ..... 114/345
3,608,114 * 9/1971 Middleton et al. ..... 441/94

FOREIGN PATENT DOCUMENTS 1562245 4/1969 (FR) .

* cited by examiner

*Primary Examiner*—Sherman Basinger
(74) *Attorney, Agent, or Firm*—Nixon Peabody LLP; David S. Safran

(57) ABSTRACT

In inflatable large-size structures such as life boats it is required that an external and easily accessible gas cylinder is hose-connected with a plurality of mutually separated injection areas, because the gas medium, by evaporation and expansion, produces a substantial reduction in temperature at each injection area there will potentially exist choking ice formations. This can be counteracted by distributing the injection over more areas or spots in order to achieve a more rapid and effective transfer of heat from the surroundings for making sure that the inflation can take place in a desirably rapid manner. Conventionally this implies that the structure exhibits exposed connector hoses to the different injection spots, these hoses causing trouble in use of the structure. With the invention it has been recognized that the relevant distribution system may be arranged in the interior of the structure, whereby these troublesome exterior hoses can be entirely avoided.

5 Claims, 1 Drawing Sheet

INFLATABLE STRUCTURE, IN PARTICULAR A LIFE FLOAT

BACKGROUND OF THE INVENTION

1. Field of the Invention

The present invention relates to an inflatable structure, in particular a life float, of the type equipped with an inflation gas source, preferably a $CO_2$ cylinder, and, departing therefrom, a distribution channel system for supplying the gas to a plurality of inflation inlets on the packed together structure.

2. Description of Related Art

For life floats and similar equipment it is very important that the inflation can be effected quite rapidly after opening of the valve of the gas cylinder, and for large size structures it is, therefore, a practical necessity that the gas cylinder is connected to more inflation inlets located with noticeable mutual spacing. This requirement is owing to the fact that the associated vivid evaporation of the $CO_2$ liquid from the cylinder produces a strong cooling, whereby the product introduced into the structure at the inflation inlets will be particles of frozen $CO_2$ liquid, the so-called $CO_2$ snow. For the desired evaporation, heat should be conveyed from the surroundings, and if the entire amount of inflation gas is let in at only a single inlet there will be a high risk of insufficient heat supply to that place; the inlet area may end up as one big ice lump, from which the gas will be only slowly generated. If, on the other hand, the gas liquid is supplied to several different areas, many times more heat can then be attracted from the close surroundings to the total amount of the supplied gas, and it is then practically possible to get down to the prescribed, relatively brief inflation times, e.g. three minutes for a large size life float, even with the use of a single gas cylinder.

On this background it is a conventional practice that the relevant units appear with a suitably placed gas cylinder with an easily accessible valve and with one or more associated hoses extending to the different inlet places, which should be located mutually spaced by at least a half or a whole meter. Thus, it is characteristic that the units present a hose system, which may be more or less well anchored to the inflatable structure, but in any case reveals itself as a problematic excrescence on the structure.

It should be mentioned that there are already known some types of internal distribution systems, e.g. as disclosed in U.S. Pat. No. 2,993,217, which, however, act to distribute the gas which has already entered the gaseous phase. In that connection it is a purpose to protect the rubber wall against the chilling shock that may occur at the injection area, but this does not change the fact that it is still at this local area the whole amount of gas is brought to evaporate.

SUMMARY OF THE INVENTION

With the invention it has been recognized that a relevant inlet area should not necessarily be a place where the injection is effected across an outer surface forming wall of the inflatable structure itself, inasfar as it is possible to establish an internal distribution system, such that an exteriorly placed gas cylinder, accessible for inspection and replacement, when needed, should only be tube or hose connected with one throughlet, from which a distribution channel system may then be branched off to extend internally in the structure, debouching at a number of different places. For the discussed conditions with respect to the conveying of heat from the close surroundings it is fully unimportant whether the gas supply is effected through a conventional injection opening through the wall of the structure or through the mouthing of a hose inside the structure. On the other hand, however, it will be an important improvement that the outside of the structure will no longer exhibit the said disturbing excrescences which, in emergency situations, may give rise to serious problems.

On this background it should be stressed that in connection with the invention the relevant purpose is to distribute the liquid gas medium, i.e. with the use of relatively narrow channels or hoses just as in connection with the known exteriorly placed distribution systems. Already in connection with a branched off hose system it will be possible to achieve a certain evaporation of the gas medium, viz. at each widening of the cross section of the flow, although this will be less significant as long as the actual cross sections are substantially the same as the one occurring at the outlet from the gas cylinder. Put another way, by coordinating the hose diameter and the number and size outlets from the hose system into the inflatable body to the size of the outlet from the liquified inflation gas cylinder, evaporative freezing of the liquified inflation gas can be prevented.

BRIEF DESCRIPTION OF THE DRAWINGS

In the following the invention is described in more detail with reference to the drawing, in which:

FIG. 1 is an illustration of the relevant prior art, while

DETAILED DESCRIPTION OF THE INVENTION

Figure 1:
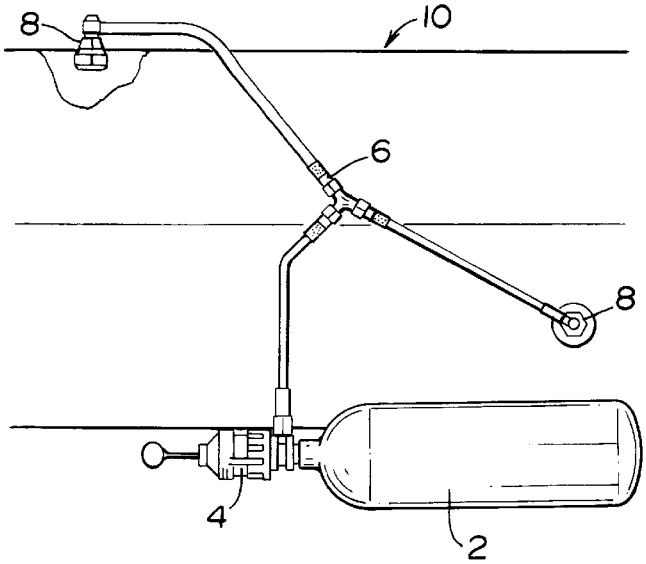
FIG. 1 (PRIOR ART)

In FIG. 1 it is shown that from a gas cylinder 2 with a release valve 4 there extends an external hose system 6 for conveying of the gas to more externally mounted inflation nozzles 8 on an inflatable structure 10. Each of these throughlets 8 are relatively costly to establish, and the hose system 6 appears as an external structure which can very easily interfere with details in the surroundings and thus create considerable problems with respect to a rapid and safe release of the life saving unit.

Figure 2:
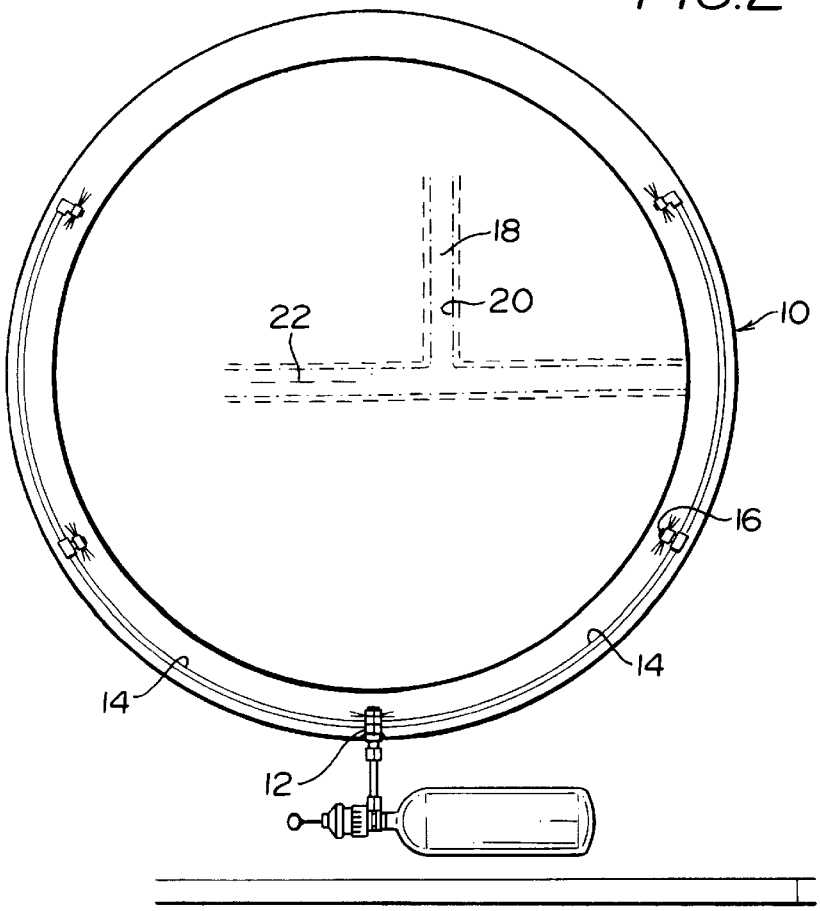
FIG. 2 is a corresponding illustration of the principle of the invention.

According to the invention, FIG. 2, the gas cylinder 2, 4 is pipe or hose connected with the inflatable unit solely by a single throughlet connection 12, from which a hose system 14 extends internally in the unit 10. It may be a combination of parallel and series connections to a suitable number of internal nozzles or simple outlets 16.

By the production of the unit 10 it is quite simple to mount the internal system 14, 16, and normally it will be sufficient to establish but a single throughlet 12.

Optionally, instead of regular hoses 14 it is possible to make use of suitably heavy sheet strips 18 which, by weldings 20, are secured to an inner wall side of the unit 10 for the formation of distribution channels. A further possibility is to make use of slit shaped inflation nozzles 22 for the gas.

What is claimed is:

1. An inflatable structure comprising:

an inflatable body;

an inflation gas source in the form of a liquified inflation gas cylinder located externally of said inflatable body; and a gas distribution system connected to said gas cylinder, said gas distribution system including an internal pressure resistant hose system extending internally through said inflatable body;

wherein said internal pressure resistant hose system is a separate member inserted into said inflatable body, has at least one hose with an inlet extending through a wall of said inflatable body for receiving liquified inflation gas from said liquified inflation gas cylinder and a plurality of outlet openings spaced along the length of the hose for distributing liquified inflation gas into said inflatable body; and wherein said at least one hose has a diameter and said plurality of outlets have a number and size which are coordinated to the size of an outlet from the liquified inflation gas cylinder as a means for preventing an evaporative freezing of the liquified inflation gas.

2. An inflatable structure according to claim 1, wherein said internal pressure resistant hose system is connected to the liquified inflation gas cylinder via an external hose system.

3. An inflatable structure according to claim 2, wherein branching connections of hoses have a cross section which is essentially the same as that of an outlet connection of the liquified inflation gas cylinder to the external hose system.

4. An inflatable structure according to claim 1, wherein said inflatable body is a life float.

5. An inflatable structure according to claim 1, wherein said at least one hose comprises a plurality of hoses connect to a single said inlet.

* * * * *